US006708811B2

(12) United States Patent
Roscoe

(10) Patent No.: US 6,708,811 B2
(45) Date of Patent: Mar. 23, 2004

(54) COIN HANDLING ASSEMBLY AND METHOD

(75) Inventor: Daniel E. Roscoe, Newton, IA (US)

(73) Assignee: Maytag Corporation, Newton, IA (US)

( * ) Notice: Subject to any disclaimer, the term of this patent is extended or adjusted under 35 U.S.C. 154(b) by 197 days.

(21) Appl. No.: 10/057,681

(22) Filed: Oct. 26, 2001

(65) Prior Publication Data

US 2003/0079662 A1 May 1, 2003

(51) Int. Cl.[7] ..... G06M 1/02; E05G 1/02
(52) U.S. Cl. ..... 194/215; 194/350; 109/53
(58) Field of Search ..... 194/215, 344, 194/350, 351; 109/49.5, 53, 55; 220/210

(56) References Cited

U.S. PATENT DOCUMENTS

| | | | | | |
|---|---|---|---|---|---|
| 649,982 | A | * | 5/1900 | Glass | 194/350 |
| 1,905,572 | A | * | 4/1933 | Sloberg | 109/66 |
| 3,724,400 | A | * | 4/1973 | Steiber | 109/53 |
| 3,774,742 | A | | 11/1973 | Magnanelli | |
| 3,926,019 | A | | 12/1975 | Mazeika | |
| 3,961,744 | A | * | 6/1976 | Kashuba, Jr. | 232/16 |
| 4,177,920 | A | | 12/1979 | Sciortino | |
| 4,363,392 | A | | 12/1982 | McDonald | |
| 4,406,358 | A | | 9/1983 | Zahradnik | |
| 4,549,418 | A | | 10/1985 | Hall | |
| 4,579,214 | A | | 4/1986 | Volk | |
| 4,697,687 | A | | 10/1987 | Wilson | |
| 4,730,715 | A | | 3/1988 | Siegenthaler | |
| 5,044,483 | A | * | 9/1991 | Stefan | 194/350 |
| 5,082,101 | A | * | 1/1992 | Baker et al. | 194/350 |
| 5,211,275 | A | | 5/1993 | Halsey et al. | |
| 5,385,225 | A | | 1/1995 | Chen et al. | |
| 5,732,878 | A | * | 3/1998 | Schroder et al. | 232/1 D |

FOREIGN PATENT DOCUMENTS

| | | | | |
|---|---|---|---|---|
| EP | 0.280.084 A2 | * | 8/1988 | G07F/9/04 |
| EP | 0.351.217 A2 | * | 1/1990 | G07F/9/04 |

* cited by examiner

*Primary Examiner*—Donald P. Walsh
*Assistant Examiner*—Mark J. Beauchaine
(74) *Attorney, Agent, or Firm*—McKee, Voorhees & Sease, P.L.C.

(57) ABSTRACT

A coin handling assembly includes a coin vault loaded completely within an appliance cabinet. The coin vault is positioned to receive coins from the coin drop and a locking member is movable from a closed position keeping coins within the coin vault to an open position permitting the coins to drop by gravity to the outside of the cabinet walls.

14 Claims, 6 Drawing Sheets

COIN HANDLING ASSEMBLY AND METHOD

BACKGROUND OF THE INVENTION

This invention relates to a coin handling assembly and a method for operating that assembly.

Present coin operated laundry equipment requires the use of a special coin box which creates several problems. FIG. 5 illustrates a typical prior art coin box. The coin box is enclosed within a cabinet having a front wall 20. A prior art drawer compartment 38 receives a coin drawer 40 which is provided with a key lock 42 having a lock tab 44 adapted to engage a latch 46. The drawer 40 includes a drawer front wall 48, and the key lock 42 is accessible from that front wall 48.

Drawer 40 must be housed in a coin drawer compartment 38 which must be designed to exact specifications to accommodate the limited selection of available coin boxes or drawers. This inflexibility complicates the design of other appliance parts.

Present prior art devices also have substantial cost due to the fact that there must be both a coin drawer receptacle 38 and a coin drawer 40 which fit one another very closely.

Another disadvantage of present devices is that the coin boxes are vulnerable to tampering and theft and are usually the component most vandalized during such attempts. Coin drawer 40 can be pried loose and opened with a minimum of effort.

Therefore, a primary object of the present invention is the provision of an improved coin handling assembly and method for using same.

A further object of the present invention is the provision of a coin handling assembly which reduces the cost of manufacture over what is currently incurred in the manufacturing cost of current drawer designs.

A further object of the present invention is the provision of a coin handling assembly and method which provides improved security by eliminating a coin box and by eliminating exposed parts of the receptacle for the coin box.

A further object of the present invention is the provision of a coin handling assembly and method which provides improved design and flexibility permitting an interior vault to be shaped to fit within the available space within an appliance.

A further object of the present invention is the provision of an improved coin handling assembly and method which permits the increasing of the holding capacity of the coin handling assembly over that provided by available coin boxes.

A further object of the present invention is the provision of a coin handling assembly and method which provides improved collector ergonomics by eliminating the need to handle heavy coin boxes.

A further object of the present invention is the provision of an improved coin handling assembly and method which are economical in manufacture, durable in use, and efficient in operation.

BRIEF SUMMARY OF THE INVENTION

The foregoing objects may be achieved by a coin handling assembly that includes a coin drop capable of receiving a plurality of coins one at a time, analyzing the value of the coins, and initiating operation of the appliance in response to receipt of coins having a predetermined value. Various types of presently available coin drops may be used, and all of these devices include a coin discharge for discharging the coins from the coin drop after receipt and analysis of the coins.

A coin vault is provided in communication with the coin discharge of the coin drop for receiving and holding the coins after the coins have been discharged from the coin discharge. The coin vault includes a bottom wall and a coin outlet opening in the bottom wall.

A locking member is movable from a closed position blocking the coin outlet to prevent the coins from exiting the coin vault to an open position permitting the coins to drop by gravity from the coin vault through the coin outlet opening. The locking member includes a lock actuator for responding only to a predetermined trigger mechanism to prevent moving of the locking member between the closed and open positions.

The trigger mechanism may be a key operated lock, or an electrical or mechanical combination lock.

According to one feature of the invention a coin chute is positioned to receive the coins exiting from the coin vault and to direct the coins externally from the appliance.

According to another feature of the invention the coin chute may be movably mounted for movement from a folded position preventing the exit of coins to an open position permitting the coins to exit from the appliance.

According to another feature of the invention the appliance includes external walls, and the coin vault is enclosed within the external walls so as not to be exposed to the outside of the appliance.

The method of the present invention includes receiving the coins in a coin drop having coin insert slots accessible from outside the appliance walls. The coin drop is used to analyze the coins and initiate actuation of the appliance in response to receipt of coins analyzed to have a predetermined value. The coins are discharged from the coin drop into a coin vault located completely within the external cabinet walls and inaccessible from outside the external cabinet walls. A bottom opening is opened in the coin vault to permit the coins within the coin vault to drop by gravity from the coin vault. The coins dropping from the coin vault are directed to the outside of the external walls of the appliance.

DETAILED DESCRIPTION OF THE INVENTION

Figure 1:
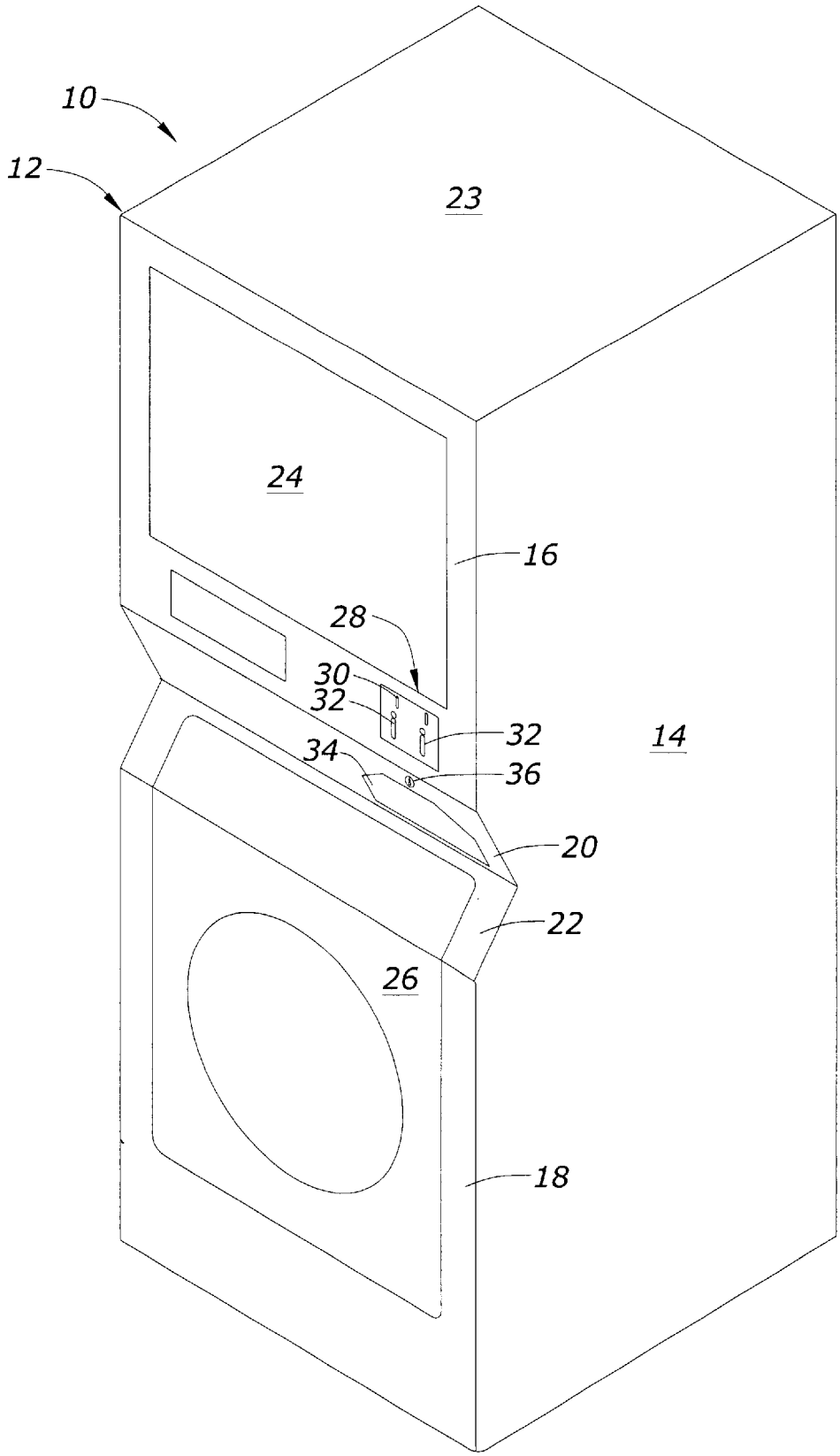
FIG. 1 is a perspective view of an appliance utilizing the coin handling assembly of the present invention.
Figure 2:
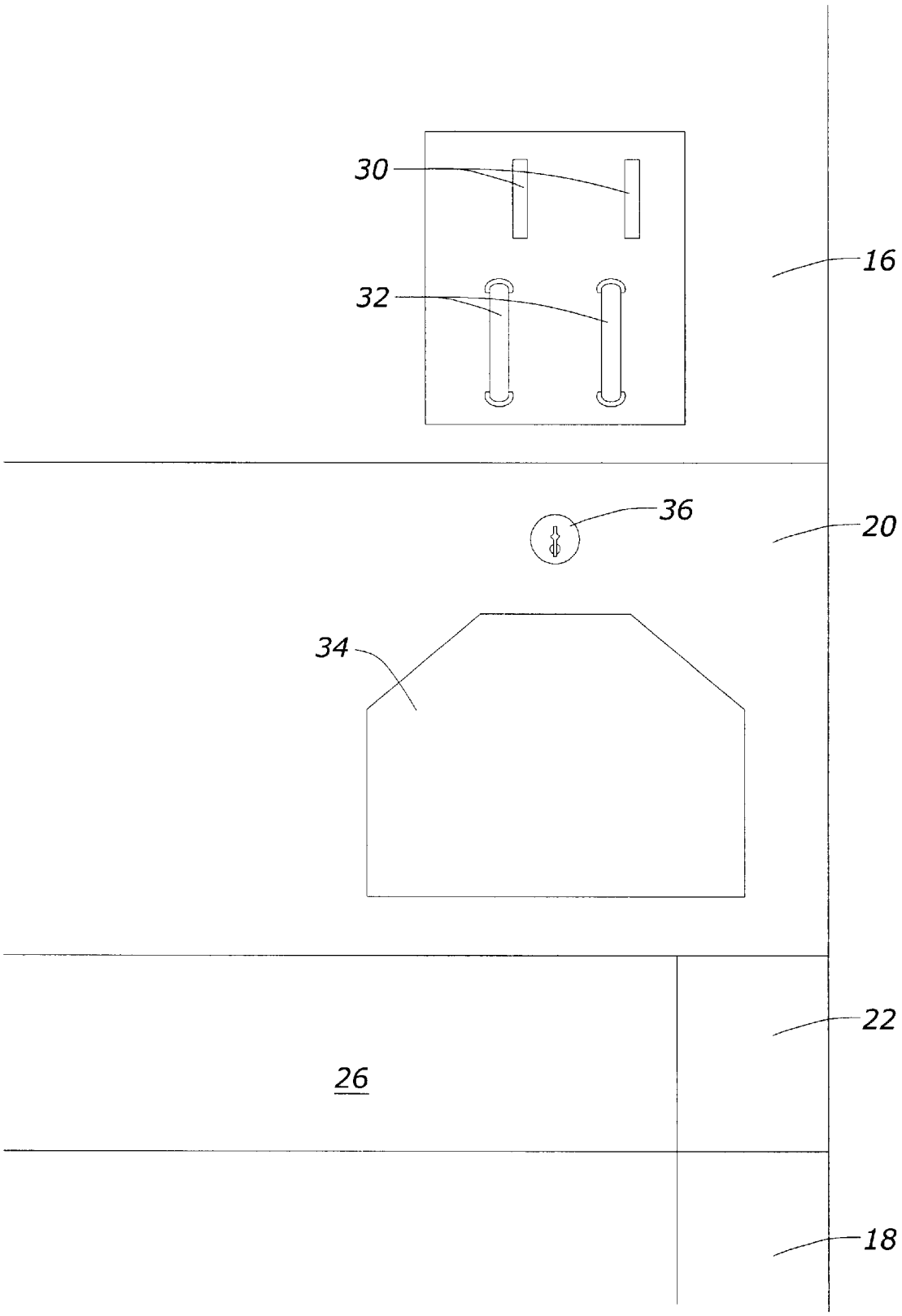
FIG. 2 is an enlarged partial front elevational view of the appliance in FIG. 1.

Referring to FIG. 1, an appliance 10 includes a cabinet 12 having side walls 14, a front upper wall 16, a front lower wall 18, an upper angled wall 20 and a lower angled wall 22. The appliance also includes a top wall 23 and a rear wall (not shown).

In the front wall 16 is an upper door 24 and in the lower front wall 18 is a lower door 26. The appliance 23 is shown to be a washer/dryer assembly, but other types of appliances could be used with the present invention. The present invention is not limited to use with any particular appliance.

In FIG. 1, the front face of a coin drop 28 is visible from the outside of the cabinet 12. Coin drop 28 includes coin slots 30 and coin returns 32. The coin drop 28 is of typical prior art construction and numerous off the shelf coin drops are available for this purpose.

Also visible in FIG. 1 from the front of cabinet 12 are an outlet chute 34 and a key receptacle 36.

Figure 3:
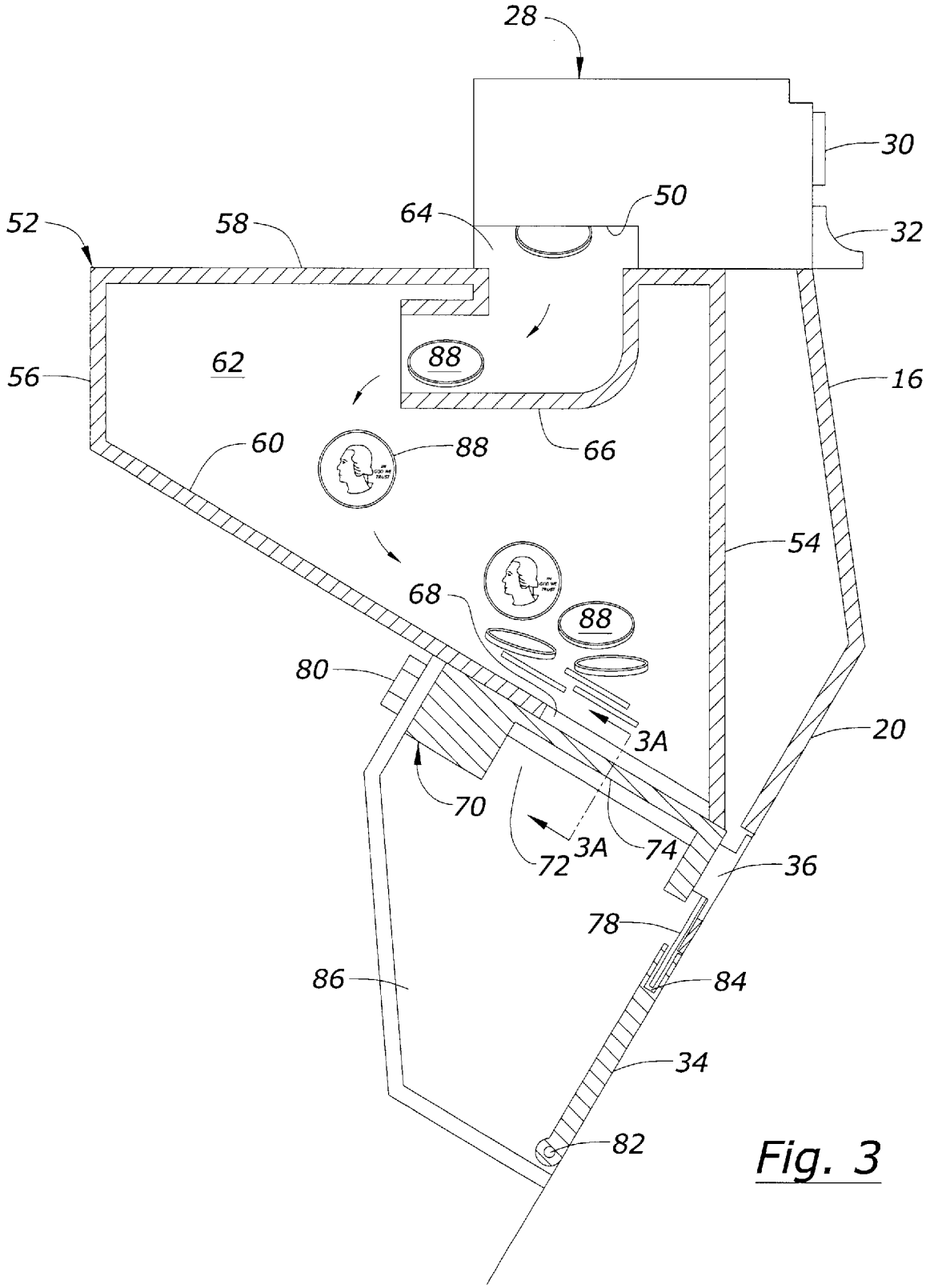
FIG. 3 is a sectional view showing the coin handling assembly of the present invention.
Figure 4:
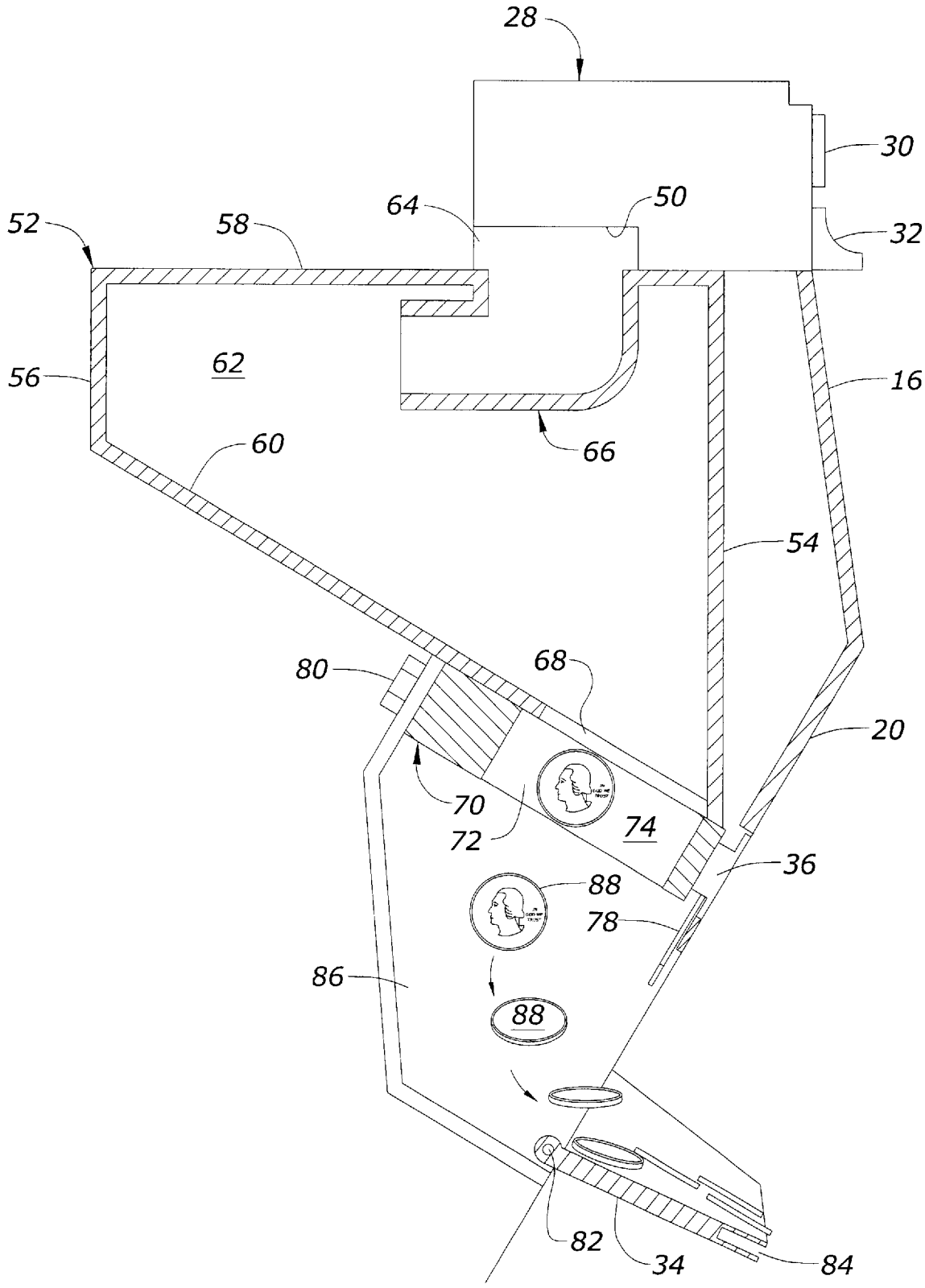
FIG. 4 is a view similar to FIG. 3, but showing the coin vault in its open position.

Coin drop 28 includes a coin drop discharge 50 shown in FIGS. 3 and 4. Below this coin drop discharge 50 is a coin vault 52 having a front wall 54, a back wall 56, a top wall 58, a bottom wall 60 and side walls 62. The top wall 58 is provided with a vault inlet opening 64 that is registered and in communication with the coin drop discharge 50. A vault coin guide 66 is provided for directing coins 88 downwardly into the coin vault 52. The bottom wall 60 of coin vault 52 is provided with a vault outlet opening 68. The bottom wall 60 and the side walls 62 of vault 52 are sloped downwardly toward the vault outlet opening 68 so that the coins will naturally move by gravity toward the coin outlet opening 68.

Figure 3A:
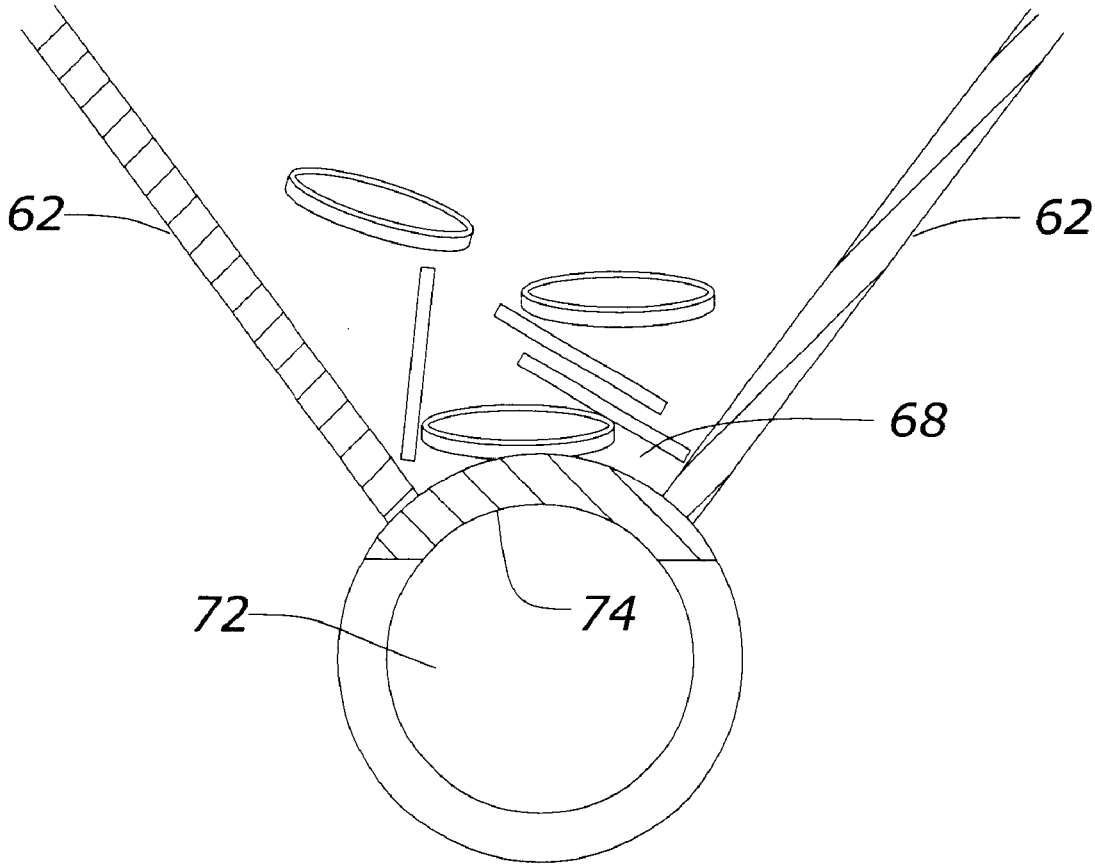
FIG. 3A is a sectional view taken along line 3A—3A of FIG. 3.

A locking member 70 includes an open space 72 intermediate its opposite ends and a curved closure web 74 which in FIGS. 3 and 3A is shown to be in covering relation over the outlet opening 68 of coin vault 52. In this position the coins are not permitted to exit through the outlet opening 68.

Locking member 70 is also provided with a key receptacle 36 which is adapted to receive a key for moving the closure web 74 out of covering relation over outlet opening 68. The key receptacle has a chute locking tab 78 extending downwardly therefrom and is mounted for rotational movement along its longitudinal axis by means of a pivot mounting bolt 80.

While the lock member 70 is shown to be provided with a key receptacle 36 other types of locks may be used, including electrical or mechanical combination locks. The locking member 70 is pivotal about its longitudinal axis from its closed position shown in FIGS. 3 and 3A to its open position shown in FIG. 4. In the open position the open space 72 is registered below the outlet opening 68 of vault 52, and the coins are permitted to drop downwardly through the outlet opening 68 and the open space 72 as illustrated in FIG. 4. These coins drop into a chute cavity 86 contained within the inside of cabinet 12. A chute 34 is pivotally mounted for hinged movement about a chute hinge 82 from its closed position shown in FIG. 3 to its open position shown in FIG. 4. The upper edge of chute 34 includes a chute locking slot 84 which receives the chute locking tab 78 when the locking member 70 is in its closed position shown in FIG. 3. When the locking member is moved to its open position shown in FIG. 4 the tab 78 moves out of the slot 84 and permits the chute 34 to pivot to its downward position. In this downward position the chute 34 guides coins 88 into a basket, bag, or other container for carrying the coins away.

Figure 5:
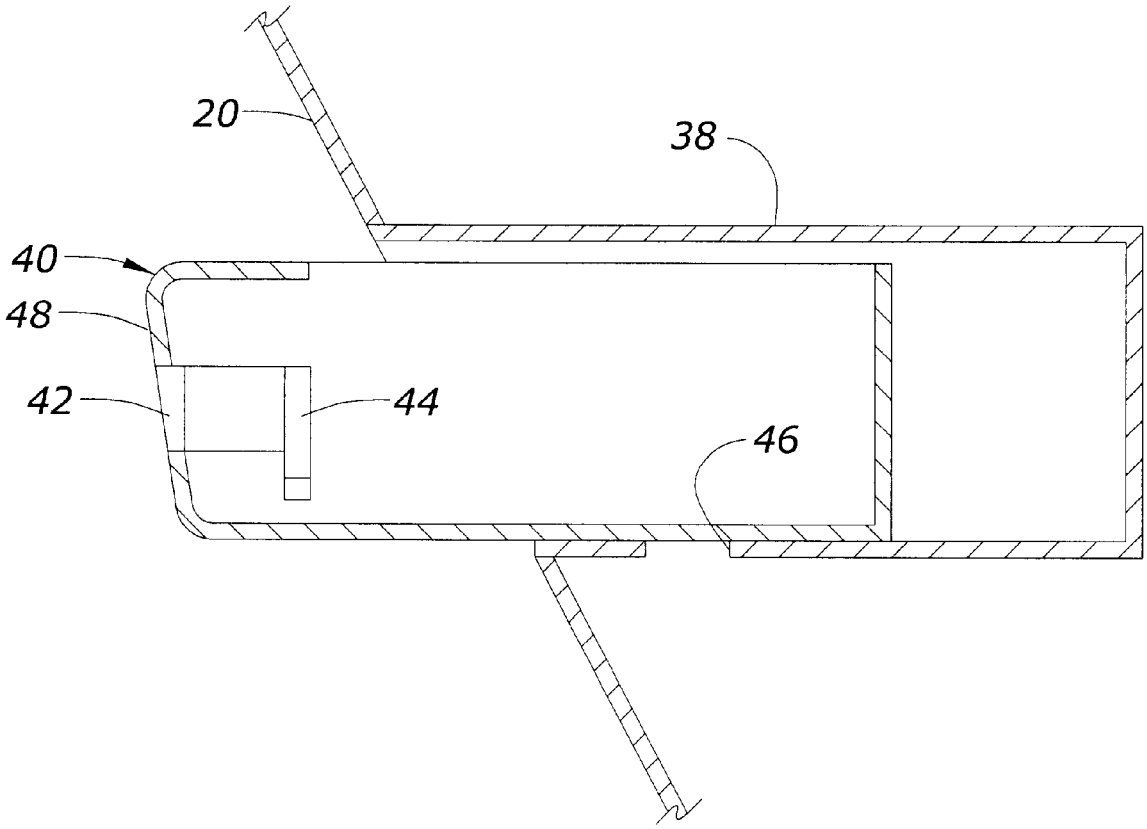
Fig. 5 (Prior Art)
FIG. 5 is a sectional view of a prior art coin handling assembly.

The vault 52 is located entirely within the cabinet walls of the cabinet 12 so that it is not accessible from outside the cabinet. This differs from the structure of the drawer type construction of the prior art shown in FIG. 5. Furthermore, the use of the vault 52 eliminates the need for a drawer such as drawer 40. This reduces the cost of the coin handling system.

Another advantageous feature of the vault 52 is that it can be made of various shapes and configurations to accommodate the particular appliance involved without interfering with the other working components of the appliance.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A coin handling assembly for a coin operated appliance comprising:

a coin drop capable of receiving a plurality of coins one at a time, analyzing the value of said coins, and initiating operation of said appliance in response to receipt of coins having a predetermined value, said coin drop having a coin discharge for discharging said coins from said coin drop after receipt and analysis of said coins;

a coin vault in communication with said coin discharge of said coin drop for receiving and holding said coins after said coins have been discharged from said coin discharge;

said coin vault having a bottom wall and a coin outlet opening in said bottom wall;

a locking member movable from a closed position blocking said coin outlet to prevent said coins from exiting said coin vault to an open position permitting said coins to drop by gravity from said coin vault through said coin outlet opening; said locking member having a lock actuator for responding only to a predetermined trigger mechanism to permit moving of said locking member between said closed and open positions.

2. A coin handling assembly according to claim 1 and further comprising a coin chute positioned to receive said coins exiting from said coin vault and direct said coins externally of said appliance.

3. A coin handling assembly according to claim 2 wherein said coin chute is movably mounted to said appliance for movement from a folded position preventing said coin chute from directing said coins externally of said appliance to an unfolded position permitting said coin chute to direct said coins externally of said appliance.

4. A coin handling assembly according to claim 3 wherein said locking member includes a chute retaining member retentively engaging said coin chute and holding said coin chute in said folded position when said locking member is in said closed position, said chute retaining member moving out of engagement with said coin chute when said locking member is moved to said open position, whereby said chute is free to move to said unfolded position.

5. A coin handling assembly according to claim 1 wherein said appliance includes external walls, and said coin vault is enclosed within said external walls of said appliance.

6. A coin handling assembly according to claim 1 wherein said locking member is mounted for rotation between said closed and said open positions.

7. A coin handling assembly according to claim 6 wherein said appliance includes external walls, said trigger mechanism of said locking member being accessible from outside said external walls of said appliance and the remainder of said locking member being within said appliance external walls.

8. A coin handling assembly according to claim 1 wherein said trigger mechanism is a key receptacle responsive to a key of predetermined configuration to permit movement of said locking member between said closed and open positions.

9. A coin handling assembly according to claim 1 wherein said trigger mechanism is a combination lock responsive to being moved to a predetermined combination of positions to permit movement of said locking member between said closed and open positions.

10. In combination: an appliance having external walls;

a coin drop having coin receiving slots accessible from outside said external walls and having a remaining portion located within said external walls and inaccessible from outside said external walls;

said coin drop having a coin discharge located within said external walls for discharging coins that have been inserted into said coin receiving slots;

a coin vault located completely within said external walls and being inaccessible from outside said external walls;

said coin vault being in communication with said coin discharge of said coin drop for receiving coins from said coin discharge;

said coin vault having a bottom wall and an outlet opening in said bottom wall that permits coins to fall out of said coin vault by gravity;

a locking member having a blocking portion movable from a closed position blocking said outlet opening of said coin vault to prevent coins from falling out of said coin vault through said outlet opening, to an open position permitting coins to fall out of said coin vault by gravity; a trigger member connected to said locking member and being responsive only to a predetermined stimuli consisting essentially of a key of predetermined configuration or an electrical or mechanical combination lock to permit movement of said locking member between said closed and said open positions.

11. A method for handling coins inserted into a coin operated appliance having external appliance walls, comprising:

receiving said coins in a coin drop having coin insert slots accessible from outside said external appliance walls;

using said coin drop to analyze said coins and initiate actuation of said appliance in response to receipt of coins analyzed to have a predetermined value;

discharging said coins from said coin drop into a coin vault located completely within said external cabinet walls and inaccessible from outside said external cabinet walls;

opening a bottom opening in said coin vault to permit said coins within said coin vault to drop by gravity from said coin vault;

directing said coins dropping from said coin vault to the outside of said external walls of said appliance.

12. A method according to claim 11 wherein said opening step further comprises opening said coin vault only in response a trigger mechanism that is accessible from outside said external walls of said appliance, said trigger mechanism selected from the group consisting essentially of an electrical or mechanical key lock or an electrical or mechanical combination lock.

13. A method according to claim 11 and further comprising closing said bottom opening in said coin vault after said coins have dropped out of said vault, whereby said closed vault will store coins discharging from said coin drop.

14. A method according to claim 13 wherein said step of closing said bottom opening comprises moving a closure member over said bottom opening and locking said closure member against movement.

* * * * *